United States Patent [19]

Grundfest

[11] 4,266,419

[45] May 12, 1981

[54] COMPRESSION TOOL

[75] Inventor: Michael A. Grundfest, Forest Hills, N.Y.

[73] Assignee: Thomas & Betts Corporation, Raritan, N.J.

[21] Appl. No.: 923,008

[22] Filed: Jul. 10, 1978

[51] Int. Cl.[2] ..... B21D 7/06

[52] U.S. Cl. ..... 72/410; 72/452; 74/577 S; 81/313

[58] Field of Search ..... 72/409, 410, 452; 81/313, 177 PP, 393; 30/187; 74/437, 577 S

[56] References Cited

U.S. PATENT DOCUMENTS

| | | | |
|---|---|---|---|
| 2,086,400 | 7/1939 | Brenizer | 81/393 |
| 2,746,327 | 5/1956 | Runde | 72/409 |
| 2,939,211 | 6/1960 | Daniels | 30/187 |
| 3,101,017 | 8/1963 | Malkin | 81/313 |
| 3,359,779 | 12/1967 | Filia | 72/452 |
| 3,475,946 | 11/1969 | Laux | 72/409 |
| 3,903,725 | 9/1975 | Rommel | 72/410 |
| 3,958,442 | 5/1976 | Walia | 82/177 PP |

*Primary Examiner*—Daniel C. Crane
*Assistant Examiner*—Gene P. Crosby
*Attorney, Agent, or Firm*—James J. Daley; Robert M. Rodrick; Jesse Woldman

[57] ABSTRACT

A preferably circular cam driver coupled to one of a pair of pivotally coupled die carrying members and operated by drive means is cooperatively engaged with a cam member coupled to the other of the pair of die carrying members and which, in turn, is rotated by and exerts a force upon the cam driver to selectively move the work engaging portions of the die carrying members into engagement with a workpiece located therebetween.

12 Claims, 10 Drawing Figures

COMPRESSION TOOL

BACKGROUND OF THE INVENTION

1. Field of the Invention

The invention is directed to the field of force-applying mechanisms for compression tools and the like.

2. Description of the Prior Art

Various mechanisms for urging together the respective jaw members of compression tools and the like are well known in the art and comprise both direct and cam operated devices in various combinations. In the latter case, such devices are often employed with a multiple stroke lever member for rotating the cam member in response to the action of the lever or handle member. Examples of such prior art devices are disclosed in the following U.S. Pat. Nos. 2,926,556 issued Mar. 1, 1960 to H. P. Dupre; 2,939,211 issued June 7, 1960 to A. G. Daniels; 3,101,017 issued Aug. 20, 1963 to B. M. Malkin et al; 3,342,059 issued Sept. 19, 1967 to Friedrich Gunther Laux; 3,475,946 issued Nov. 4, 1969 to F. G. Laux; 3,359,779 issued Dec. 6, 1967 to G. J. Filia; and 3,903,725 issued Sept. 9, 1975 to Reiner Rommel. It is to be noted that such mechanisms generally comprise a rather complex arrangement of interengaging parts which are both expensive and generally subject to frequent repair, realignment and replacement. Consequently, there is a need in such field for an improved force-applying mechanism which is both simple, inexpensive and readily adaptable for use in compression tools and the like.

SUMMARY OF THE INVENTION

The invention overcomes the limitations and difficulties noted above with respect to such prior art devices by providing a simple and inexpensive force-applying mechanism for employment preferably in a compression tool or the like. In a preferred embodiment, the device comprises a rotatable preferably circular cam driver coupled to one of a pair of die carrying or jaw members and a rotatable cam member coupled to the other die carrying or jaw members and respectively positioned for contacting engagement with the cam member whereby the cam driver abuts the cam member in selective positions and drives the cam member which, in turn, applies a force to the cam driver which is transmitted to its respective die carrying or jaw member to cause such jaw member to be urged towards the opposing die carrying or jaw member, thereby creating a compression force therebetween. The jaw members are pivotingly coupled together at a point which may be sufficiently removed from the location of the cam driver and cam member so as to provide a force-multiplying effect in the work area of the respective jaw members. The cam driver may be driven by a lever means which is provided with a pawl member to provide a ratchet-type multiple-stroke action for rotating the cam driver. Both the cam member and the cam driver are provided with a toothed portion on their respective peripheries to impart rotational movement therebetween while the smooth portion of the peripheries adjacent the toothed portions are employed to transmit the force created between the cam member and the cam driver during the operational stroke of the tool. It is therefore an object of this invention to provide an improved force-applying mechanism for a compression tool or the like.

It is another object of this invention to provide a simple force-applying mechanism for a compression tool or the like.

It is a further object of this invention to provide an inexpensive force-applying mechanism for a compression tool or the like.

It is still another object of this invention to provide a mechanism for improving the efficiency of a compression tool or the like.

It is yet another object of this invention to provide a low cost, and efficient multiple-stroke compression tool or the like.

It is still a further object of this invention to provide an improved cam operated force-applying mechanism for a compression tool or the like.

It is yet a further object of this invention to provide a simple and efficient cam operated force-applying mechanism for a compression tool or the like.

It is yet another object of this invention to provide a force-applying mechanism wherein a relatively constant input force may be utilized to impart a variable output force to the die carrying members of a compression tool or the like.

It is still another object of this invention to provide an improved multiple stroke cam-operated compression tool or the like.

Other objects and features of the invention will be pointed out in the following description and claims and illustrated in the accompanying drawings which disclose, by way of example, the principle of the invention and the best mode contemplated for carrying it out.

DESCRIPTION OF THE PREFERRED EMBODIMENTS

Figure 1:
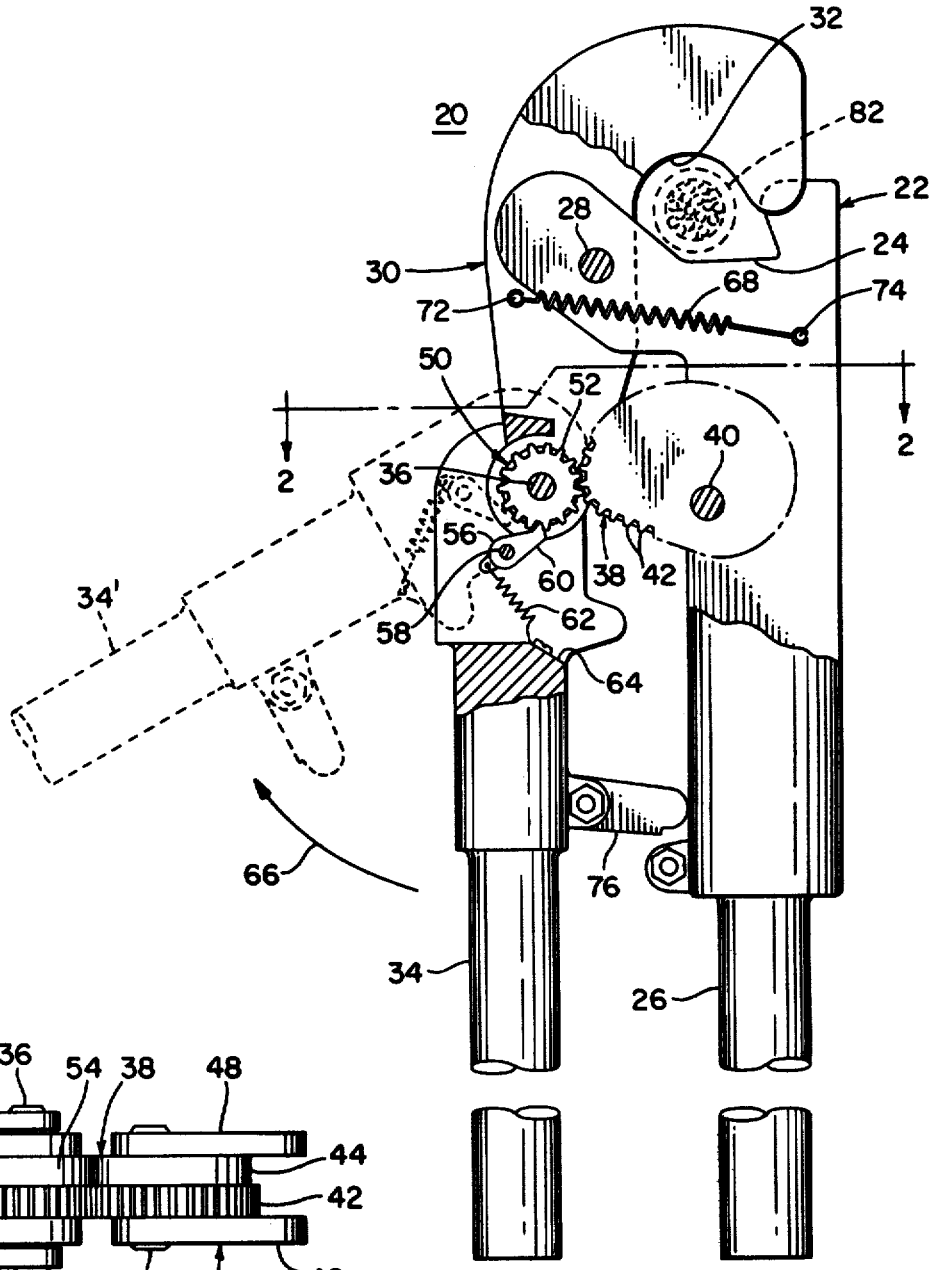
FIG. 1 is a fragmentary front elevational view, partly cut away and partly in section, of a compression tool constructed in accordance with the concepts of the invention.
Figure 2:
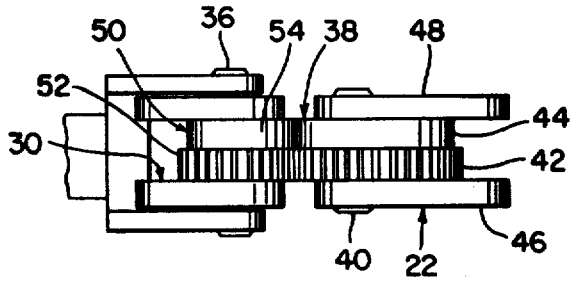
FIG. 2 is a fragmentary sectional view taken along the line 2—2 of FIG. 1.
Figure 3:
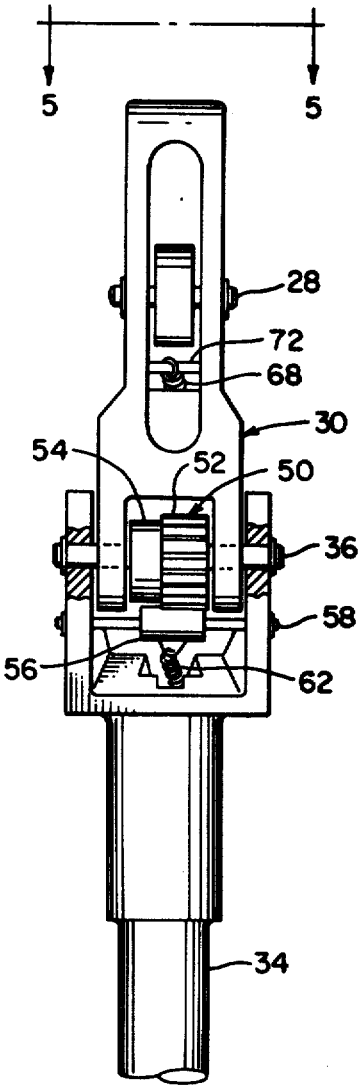
FIG. 3 is a fragmentary left side elevational view, partly in section, of a portion of the device of FIG. 1.
Figure 4:
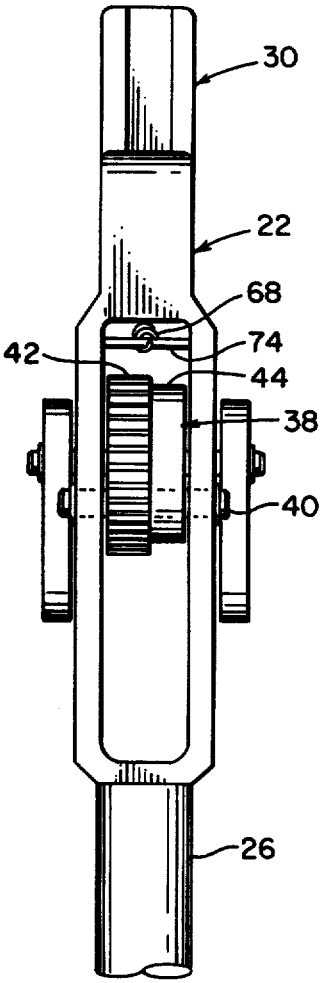
FIG. 4 is a fragmentary right side elevational view of the device of FIG. 1.
Figure 5:
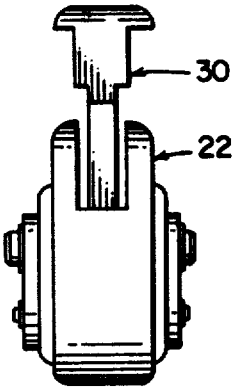
FIG. 5 is a top plan view taken along the line 5—5 of FIG. 3.
Figure 6:
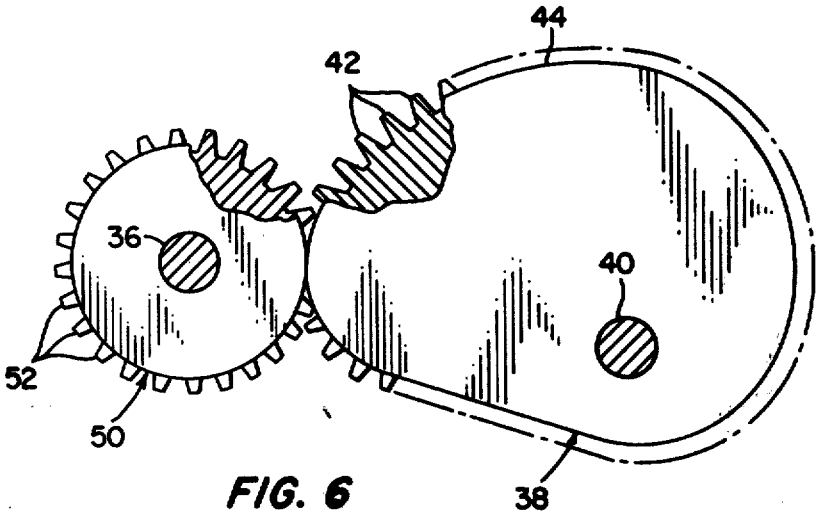
FIG. 6 is an enlarged view, partly cut away and partly in section, of the cam member and cam driver of the device of FIG. 1.
Figure 7:
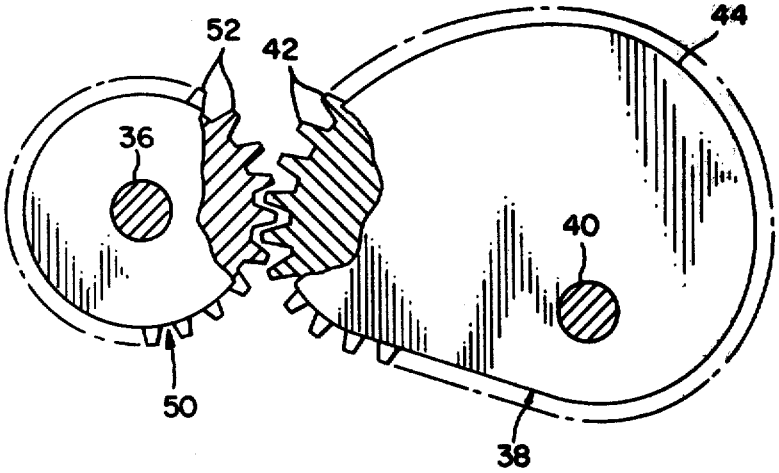
FIG. 7 is an enlarged view, similar to FIG. 6, and partly cut away and partly in section, of the cam member and cam driver of the device of FIG. 1 showing the interengagement of their respective teeth.
Figure 10:
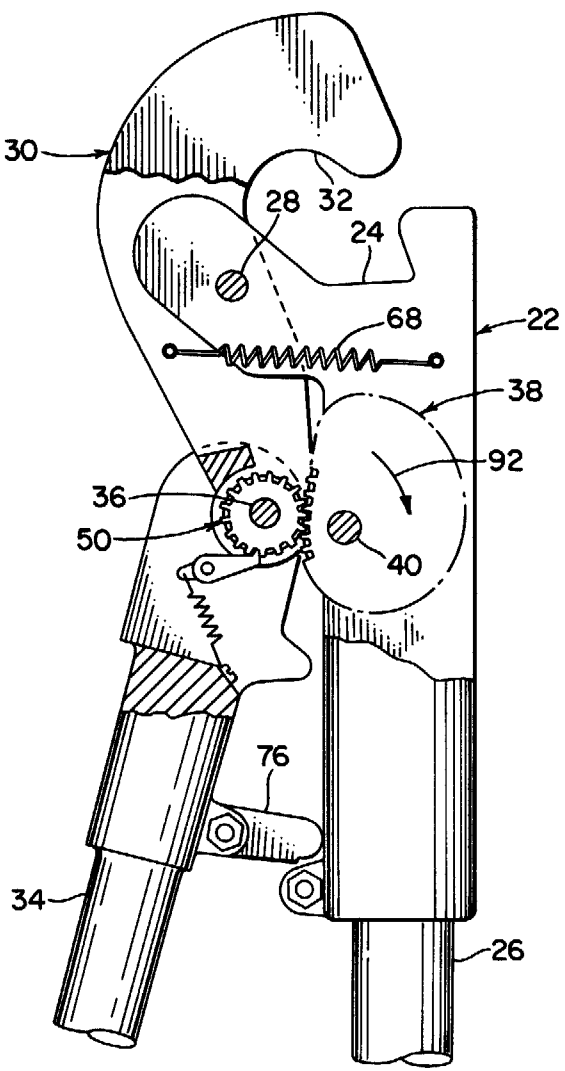
FIGS. 8, 9, and 10 are fragmentary front elevational views, partly cut away and partly in section, of the device of FIG. 1, showing the parts in various states of operation.
Figure 9:
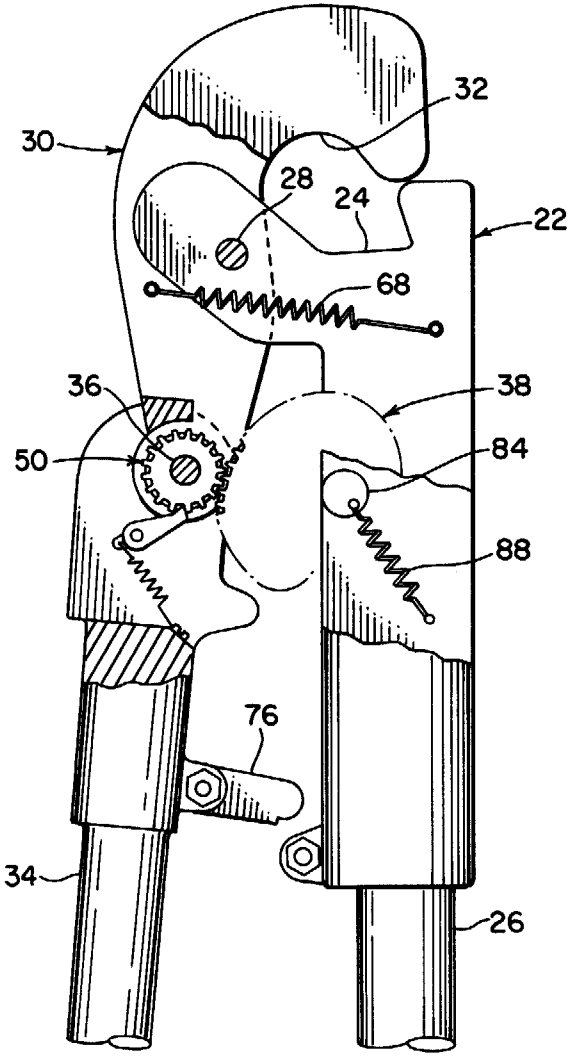
Figure 8:
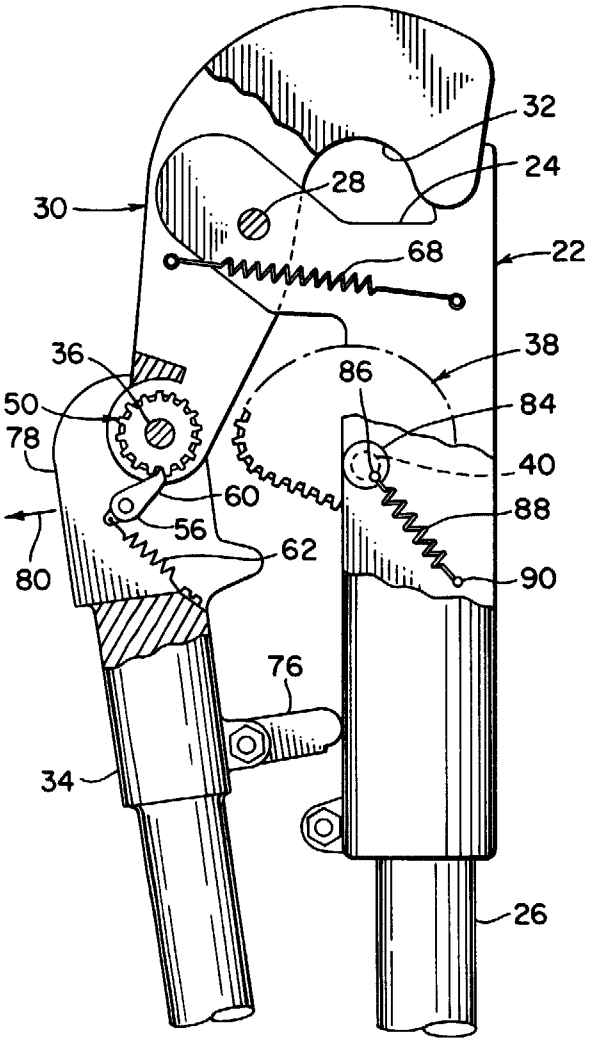

Turning now to FIGS. 1 through 10, there is shown a compression tool 20 constructed in accordance with the concepts of the invention. The tool 20 comprises a relatively stationary first die carrying member 22 having a die carrying portion 24 at one end and a handle portion 26 at its other end. Means such as a pivot pin 28 pivotally couples the first die carrying member 22 to a relatively movable second die carrying member 30 which comprises a die carrying portion 32 at one end in opposed relation to the portion 24 of member 22, and which is movably coupled to a handle portion 34 by means of a pivot pin 36. Intermediate the die carrying portion 24 and the handle portion 26 of the member 22 is a cam member 38 shown as having an eccentric periphery and which is rotatably coupled to the member 22 by a pin 40. As is more clearly shown in FIG. 2, the cam member 38 is provided on its periphery with a series of teeth 42 extending thereabout directly adjacent a relatively smooth cam surface 44. The cam member 38 is located between the spaced sides 46 and 48 of the die carrying portion 24 of the member 22 and is free to rotate therebetween. The cam member 38 is arranged to contactingly engage a preferably circular cam driver 50 which is rotatably coupled to the second die carrying member 30 by means of the pin 36. The cam driver 50 is also provided about its periphery with a series of teeth 52 which are arranged to mesh with the teeth 42 of the cam member 38 to drive the cam member about its pin 40. The teeth 52 of the cam driver 50 are also similarly disposed directly adjacent a relatively smooth surface 54 (FIG. 2) which is arranged for direct abutting contact with the surface 44 of cam member 38, as is more clearly shown in FIG. 6. Thus, the teeth 52 of the cam driver 50 are employed principally to rotate the cam member 38 while the force generated between the cam driver 50 and the cam member 38 is taken up principally by the contacting engagement between their opposed respective surfaces 54 and 44. The cam driver 50 is driven about its pin 36 by a pawl 56 which is pivotally coupled to the handle portion 34 by a pin 58 and is provided with a nose portion 60 which is adapted to provide a one-way engagement with the teeth 52 of the cam driver 50 under the influence of a biasing means shown as a spring 62 extending from the pawl 56 to a fixed point 64 on the handle portion 34. Thus, as the handle portion 34 is moved in a clockwise direction, as indicated by the arrow 66 in FIG. 1, to a position shown by the dotted outline 34' in FIG. 1, the nose portion 60 of the pawl 56 is caused to ride over the teeth 52 of the cam driver 50 and, upon the reverse movement of the handle portion 34, will engage an adjacent tooth of the cam driver 50, causing the cam driver 50 to be rotated in a counterclockwise direction, as viewed in FIG. 1. The engagement of the respective teeth 52 and 42 of the cam driver 50 and the cam member 38 is shown more clearly in FIG. 7. As illustrated, the teeth 42 of the cam member 38 are arranged to loosely mate with the teeth 52 of the cam driver 50 and are held in this slightly parted position by virtue of the abutting engagement of the respective surfaces 54 and 44 of the cam driver 50 and cam member 38. Thus, the teeth 52 of the cam driver 50 serve merely to rotate the cam member 38 while the pressure or force generated between the two members 50 and 32 is absorbed by the contacting surfaces 54 and 44. Located intermediate the pivot pin 28 and the respective pivot pins 36 and 40 of the cam driver 50 and cam member 38 is a means which is shown as a tension spring 68 one end 70 of which is fastened to the second die carrying member 30 by a pin 72, and the other end 73 of which is fastened to the first die carrying member 22 by a pin 74. The spring 68 is employed to exert a force tending to urge the two die carrying members 22 and 30 together which, in turn, tends to bring the cam member 38 into engagement with the cam driver 50 during the entire operational cycle of the tool 20. To maintain the handle portions 34 and 26 in a slightly parted position and to prevent their closure upon the fingers of a user, there is provided a stop means shown as an extension 76 attached to and protruding from the handle portion 34 towards the first die carrying member 22. By adjusting the length or angle of the extension 76, the spacing between the handle portions 34 and 26 may be conveniently regulated to provide the desired spacing therebetween. The extension 76 may also serve as a fulcrum for the selective release of the cam driver 50 from the cam member 38, where necessary or desirable, as illustrated, for example, in FIG. 8. In such event, the handle portion 34 is brought inwardly towards the handle portion 26, causing the extension 76 to contact the first die carrying member 22 at its lower end below the pivot pin 40. This, in turn, causes the upper end 78 of the handle portion 34 to swing outwardly away from the first die carrying member 22 in a direction indicated by the arrow 80, thereby causing the cam driver 50, which is coupled to the handle portion 34, to disengage from the cam member 38, substantially as shown. Upon its disengagement from the cam driver 50, the cam member 38 is now free to rotate about the pin 40. To provide a reset for the cam member 38 wherein the die carrying portions 32 and 24 are at their maximum spaced apart position preparatory to receiving a workpiece such as 82 (FIG. 1) therebetween, there may be provided a mechanism comprising a stud extension 84 (FIG. 8) which is fixedly coupled to the cam member 38 and is provided with a pin 86 radially offset from the central axis of rotation of the stud extension 84 and to which is attached one end of a biasing means shown in FIG. 8 as a spring 88, the other end of which is attached to a suitable point on the first die carrying member by a second pin 90. The location of the pin 86 is so chosen as to cause the cam member 38 to assume a position substantially as shown in FIG. 10 under the influence of the spring 88 when it is released from engagement with the cam driver 50. Upon the release of the handle portion 34, the second die carrying member 30, under the influence of the spring 68, will be again urged towards the first die carrying member 22 to assume a position substantially as shown in FIG. 10. The cam driver 50 and the cam member 38 are thus again brought into contacting engagement and the tool 20 is now in condition for the initiation of the next operative cycle. The handle portion 34 may now be ratcheted about the pin 36 in a back and forth movement to drive the cam driver 50 in a counterclockwise direction, as viewed in FIG. 10, which drives the cam member 38 in a clockwise direction as indicated by the arrow 92 in FIG. 10. It should be noted that, at the initiation of the operative cycle, the pivot pins 36 and 40 which support the cam driver 50 and the cam member 38, respectively are at their closest positions relative to one another, and the respective die carrying portions 24 and 32 of the first and the second die carrying members 22 and 30 are at their maximum spaced relationship (see FIG. 10). As the cam member 38 is rotated about its pivot pin 40 by the cam driver 50, the cam surface 44 bears against the surface 54 of the cam driver 50 and, due to the eccentric configuration of the cam surface 44, causes the cam driver to be driven away from the pivot pin 40, thereby causing the second die carrying member to pivot about its pin 28 in such manner as to drive the die carrying portion 32 of the second die carrying member 30 towards the die carrying portion 24 of the first die carrying member 22. Consequently, a workpiece such as 82 (FIG. 1) located between the die carrying portions 32 and 24 is subjected to a compressive force which may be advantageously employed for crimping purposes or the like. The relative position of the cam driver 50, the cam member 38, and the first and second die carrying members 22 and 30, respectively, during the rotation of the cam member 38 and the progression of the operative cycle, are illustrated, respectively, in FIG. 10, FIG. 9, and FIG. 1, with maximum closure of the die carrying portions 32 and 24 occurring at the position of the cam member 38 shown in FIG. 1 wherein the point on the cam surface 44 which is at a maximum distance from the pivot pin 40 is in contacting engagement with an adjacent point on the surface 54 of the cam driver 50. To restrain the movement of the cam driver 50 in a direction opposite to its driving direction, there may be provided a second pawl member (not shown) similar to the pawl 56 but arranged to engage the teeth 52 of the cam driver 50 and prevent it from rotating in a reverse direction at that portion of the operative cycle at which the handle portion 34 is moved from a first position shown by the solid outline in FIG. 1 to a second position shown by the dotted outline in FIG. 1. Other arrangements such as ball-detent combinations or various well-known clutch arrangements (not shown) may be employed to accomplish this purpose without departing from the spirit of the invention and within the concepts herein disclosed.

It should be further noted that the contour of the cam surface 44 of the cam member 38 may be readily varied to provide virtually any desired force curve during the operative cycle as a function of the rotation of the cam driver 50. For example, the cam surface 44 may be so designed as to provide a rapid closure movement of the die carrying portions 32 and 24 of the tool 20 during the early part of the operative stroke, with full closure occurring in smaller increments during the remainder of the operative cycle. Conversely, the contour of the cam surface 44 may be so designed as to provide a relatively uniform rate of closure of the die carrying portions 32 and 24 throughout one complete revolution of the cam member 38. Such variations may be accomplished simply by controlling both the location of the pivot pin 40 relative to the periphery of the cam member 38 and the shape of its periphery, so that the curve generated by a point on the periphery of the cam member 38 as the cam member 38 is rotated about the pivot pin 40 corresponds to the desired closure versus cam member angle curve.

It will be further appreciated that both the diameter of the cam driver 50 and the number of teeth 52 thereon may also be varied to provide a further variation in the force-stroke relationship and stroke-closure relationship of the tool 20.

Although the motive power for the cam driver 50 is shown as an elongated handle portion 34 in the preferred embodiment, it will be readily apparent to those skilled in the art that the invention contemplates no such limitation and that other convenient means such as electric, hydraulic, and pneumatic drive means (not shown) may be cooperatively coupled thereto without departing from the spirit of the invention and within the concepts disclosed herein. Furthermore, although both the cam driver 50 and the cam member 38 are each shown as having a single force absorbing surface and a single series of teeth, this arrangement may be readily modified, where necessary or desirable, to provide additional elements of like nature in juxtaposed relationship on each member in any desired pattern or sequence with a mating arrangement on the other member. For example, the peripheral surface 54 of the cam driver 50 may be flanked on both of its sides by a series of teeth such as 52 with a similar mating arrangement provided on the cam member 38. Conversely, the teeth 52 of the cam driver 50 may be flanked on both of its sides by surfaces such as 54 which, in either case, may provide for an increased balancing of the forces applied to these members during the operative stroke.

The embodiments of the invention in which an exclusive property or privilege is claimed are defined as follows:

1. A compression tool, comprising: a first and a second die carrying member; means pivotally coupling said first die carrying member to said second die carrying member; a cam member rotatably mounted on said first die carrying member and having a cam surface; a cam driver rotatably mounted through its central axis of rotation on said second die carrying member and having a cam surface in selective contacting relationship with said cam surface of said cam member for selectively moving said first and said second die carrying members with respect to one another in response to the angular position of said cam member relative to said cam driver; a lever member coupled to said cam driver for selectively driving said cam driver about its central axis of rotation in a first direction; and a projection on said lever member extending towards said first die carrying member and arranged for abutting contact therewith to provide a fulcrum for said lever member at selective positions of said lever member relative to said first die carrying member.

2. A compression tool, comprising: a first and a second die carrying member; means pivotally coupling said first die carrying member to said second die carrying member; a cam member rotatably mounted on said first die carrying member and having a cam surface; a cam driver rotatably mounted through its central axis of rotation on said second die carrying member and having a cam surface in selective contacting relationship with said cam surface of said cam member for selectively moving said first and said second die carrying members with respect to one another in response to the angular position of said cam member relative to said cam driver; means coupled to said cam driver for selectively driving said cam driver about its central axis of rotation in a first direction; and second resilient means coupled between said first die carrying member and said cam member for selectively resetting said cam member to a predetermined position when said cam member is disengaged from said cam driver.

3. A compression tool, comprising: a first and a second die carrying member; means pivotally coupling said first die carrying member to said second die carrying member; cam means rotatably mounted on said first die carrying member, said cam means comprising a first smooth cam portion and a first toothed gear portion adjacent said first smooth cam portion, said first gear portion permitting said cam means to be selectively driven; cam driver means rotatably mounted through its central axis of rotation on said second die carrying member and having a second smooth cam portion in selective contacting relationship with said first cam portion of said cam means for selectively moving said first and said second die carrying members with respect to one another in response to the angular position of said first cam portion relative to said second cam portion; said cam driver means further comprising a second toothed gear portion adjacent said second smooth cam portion, for selective engagement with said first toothed gear portion of said cam means to selectively drive said cam means in response to the rotation of said cam driver means, said first cam portion of said cam means and said second cam portion of said cam driver means are proportioned to limit the forces applied to said first gear portion and said second gear portion to the tangential component of the forces applied to said cam means and said cam driver means; and means coupled to said cam driver means for selectively driving said cam driver means about its central axis of rotation.

4. A compression tool as defined in claim 3 wherein said first cam portion of said cam means and said second cam portion of said cam driver means are further proportioned to control the interengagement of said first gear portion and said second gear portion.

5. A compression tool as defined in claim 3 wherein said first cam portion of said cam means and said second cam portion of said cam driver means are further proportioned to limit the forces applied thereto to the radial components of the forces applied to said tool.

6. A compression tool as defined in claim 3 further comprising pawl means operatively coupled to said second toothed gear portion of said cam driver means for restraining the rotation of said cam driver means in a second direction opposite said first direction.

7. A compression tool as defined in claim 3 wherein each of said teeth on said first toothed gear portion of said cam means extends outwardly from said first toothed gear portion substantially perpendicular to a line tangential to said first cam portion of said cam means at the intersection of said tooth and said cam portion of said cam means.

8. A compression tool as defined in claim 3 further comprising first resilient means coupled between said first and said second die carrying members and arranged to urge said first and second die carrying members towards one another.

9. A compression tool as defined in claim 3 wherein said means for driving said cam driver means comprises a lever member.

10. A compression tool as defined in claim 9 wherein said lever member is pivotally coupled to said second die carrying member.

11. A compression tool as defined in claim 3 wherein said cam driver means is arranged for disengagement from said cam means upon the selective pivoting of said second die carrying means about said means pivotally coupling said first die carrying member to said second die carrying member.

12. A compression tool as defined in claim 3 wherein said cam means is mounted for eccentric rotation on said first die carrying member.

* * * * *